US012434121B2

(12) United States Patent
McLellan

(10) Patent No.: US 12,434,121 B2
(45) Date of Patent: Oct. 7, 2025

(54) BOXXYBALL

(71) Applicant: Alexander William McLellan, Encinitas, CA (US)

(72) Inventor: Alexander William McLellan, Encinitas, CA (US)

(73) Assignee: Alexander W. McLellan, Encinitas, CA (US)

( * ) Notice: Subject to any disclaimer, the term of this patent is extended or adjusted under 35 U.S.C. 154(b) by 574 days.

(21) Appl. No.: 17/937,612

(22) Filed: Oct. 3, 2022

(65) Prior Publication Data

US 2023/0141648 A1 May 11, 2023

Related U.S. Application Data

(60) Provisional application No. 63/276,532, filed on Nov. 5, 2021.

(51) Int. Cl.

| | |
|---|---|
| ***A63B 67/00*** | (2006.01) |
| ***A63B 61/00*** | (2006.01) |
| ***A63B 61/02*** | (2006.01) |
| ***A63B 69/00*** | (2006.01) |

(52) U.S. Cl.

CPC ..... *A63B 67/002* (2013.01); *A63B 61/00* (2013.01); *A63B 61/02* (2013.01); *A63B 67/007* (2013.01); *A63B 69/0095* (2013.01); *A63B 2067/005* (2013.01); *A63B 2210/50* (2013.01); *A63B 2225/093* (2013.01)

(58) Field of Classification Search

CPC ..... A63B 61/00; A63B 61/003; A63B 61/006; A63B 67/00; A63B 67/002; A63B 2067/005; A63B 63/00; A63B 63/08; A63B 61/02

See application file for complete search history.

(56) References Cited

U.S. PATENT DOCUMENTS 4,231,572 A * 11/1980 Thornton ..... A63B 61/006 473/462
4,457,513 A * 7/1984 Thompson ..... A63B 61/006 273/342

(Continued)

FOREIGN PATENT DOCUMENTS

CN 206631135 U * 11/2017
CN 222266074 U * 12/2024 ..... A63B 61/00

*Primary Examiner* — David L Lewis

(57) ABSTRACT

A ball game is submitted. The ball game has an elevated, flat surface which resembles a volleyball net, but where there are three rows of ten boxes. Each hole (box) in the net is 12 inches×12 inches, and the game ball is around 5 inches in diameter. A user stands on either side of the elevated, flat surface and may throw the ball through one of the holes (boxes) in the elevated, flat surface. Another user stands on the opposite side of the elevated, flat surface and may catch the ball and return it in the same way. The height of the elevated, flat surface which resembles a volleyball net, the number, and dimensions of the holes (boxes), and the size of the game ball may be changed/adjusted. However, the holes (boxes) in the net are at least 50% larger than the diameter of the game ball, e.g., in another embodiment, there are three rows of eight boxes, where each hole (box) in the net is 14 inches×14 inches, and the game ball is around 6 inches in diameter.

6 Claims, 13 Drawing Sheets

(56) References Cited

U.S. PATENT DOCUMENTS

| | | | | | |
|---|---|---|---|---|---|
| 4,592,555 | A * | 6/1986 | Bradford | A63B 67/00 | 273/402 |
| 4,941,663 | A * | 7/1990 | Walker | A63B 71/022 | 473/459 |
| 5,058,899 | A * | 10/1991 | Jackson | A63B 61/003 | 273/402 |
| 5,072,947 | A * | 12/1991 | Blue | A63B 59/80 | 273/371 |
| 2004/0072633 | A1 * | 4/2004 | Webb | A63B 63/004 | 473/478 |
| 2006/0091609 | A1 * | 5/2006 | Dovrat | A63B 63/00 | 273/398 |
| 2007/0049428 | A1 * | 3/2007 | Stromsborg | A63B 71/022 | 473/451 |
| 2016/0303446 | A1 * | 10/2016 | Free | A63B 61/02 | |
| 2018/0185727 | A1 * | 7/2018 | Nelson | A63B 71/022 | |

* cited by examiner

BOXXYBALL

BACKGROUND OF INVENTION

The invention relates to a novel catch-and-throw game, volleyball-type game court, and unique apparatus where the game ball is caught and thrown through the elevated flat surface which resembles a volleyball net, but where there are three rows of ten boxes and each hole (box) in the net is 12 inches×12 inches.

The popularity of ball games is a burgeoning one, particularly volleyball-type games. In traditional volleyball, two teams separated by a net, compete against the other within the confines of a rectangular court. However, many individuals lack the necessary strength, skill and coordination, discouraging participation, even in recreational play. Accordingly, it is desirable to provide a ball game where less strength, skill and coordination is required, and where a broader range of individuals can participate.

In response thereto, I have invented a novel catch-and-throw ball game and enabling apparatus, therefore, which allows a broader range of players, as well as those with less skill, strength and coordination to participate, so many more can enjoy a fun activity, grow in sporting confidence and benefit from a healthier lifestyle.

Over the years, numerous games have been invented which incorporate an elevated, flat surface used to play a ball game. For example, U.S. Pat. No. 5,674,139 discloses a system, and apparatus provides multiple players with a unique competitive game. Further, U.S. Pat. No. 8,282,511 discloses a court and method for playing a game. However, these games fail to provide a ball game having the unique features described below wherein a user catches and throws the ball through a hole (box) in the elevated, flat surface which resembles a volleyball net, but where there are three rows of ten boxes and each hole (box) in the net is 12 inches×12 inches.

A game for playing on the game court is disclosed, comprising a novel catch-and-throw ball game. The game court may also be used for other sports such as volleyball, soccer-volleyball, badminton, and other ball/racquet games.

SUMMARY OF INVENTION

A ball game is submitted.

The ball game has an elevated, flat surface which resembles a volleyball net, but where there are three rows of ten boxes. Each hole (box) in the net is 12 inches×12 inches, and the game ball is around 5 inches in diameter.

A user stands on either side of the elevated, flat surface and may throw the ball through one of the holes (boxes) in the elevated, flat surface. Another user stands on the opposite side of the elevated, flat surface, and may catch the ball and return it in the same way.

The height of the elevated, flat surface which resembles a volleyball net, the number and dimensions of the holes (boxes), and the size of the game ball may be changed/adjusted. However, the holes (boxes) in the net are at least 50% larger than the diameter of the game ball, e.g., in another embodiment, there are three rows of eight boxes, where each hole (box) in the net is 14 inches×14 inches, and the game ball is around 6 inches in diameter.

An advantage of the present device is to provide a ball game wherein a player stands on one side of the elevated, flat surface and may throw a ball through a hole (box) in the elevated, flat surface, and wherein another player stands on the opposite side of the elevated, flat surface and may catch the ball and return it in the same way.

Another advantage is reducing the strength, skill and coordination required to participate in volleyball-type activities, reaching a greater number of people and encouraging a broader range of players to get involved, e.g., creating a platform for younger, older, or physically-challenged players.

Yet another advantage of the present device is to provide a ball game which is lightweight and easy to transport.

And another advantage of the present device is to provide a ball game that can be easily assembled or disassembled.

Still another advantage of the present device is to provide a ball game that can be changed/adjusted for the height, age or ability of the player.

Another advantage of the present device is to provide a ball game which is inexpensive to produce and fun to play.

For a more complete understanding of the above listed features and advantages of the present ball game, reference should be made to the following detailed description of the preferred embodiments.

Further, additional features and advantages of the invention are described in, and will be apparent from, the detailed description of the preferred embodiments.

DETAILED DESCRIPTION OF PREFERRED EMBODIMENTS

A ball game is submitted.

The ball game has an elevated, flat surface which resembles a volleyball net, but where there are three rows of ten boxes. Each hole (box) in the net is 12 inches×12 inches, and the game ball is around 5 inches in diameter.

A user stands on either side of the elevated, flat surface and may throw the ball through one of the holes (boxes) in the elevated, flat surface. Another user stands on the opposite side of the elevated, flat surface and may catch the ball and return it in the same way.

The height of the elevated, flat surface which resembles a volleyball net, the number and dimensions of the holes (boxes), and the size of the game ball may be changed/adjusted. However, the holes (boxes) in the net are at least 50% larger than the diameter of the game ball, e.g., in another embodiment, there are three rows of eight boxes, each hole (box) in the net is 14 inches×14 inches, and the game ball is around 6 inches in diameter.

The elevated, flat playing surface resembling a volleyball net may be made from rope-like material, for example, nylon or some other lightweight material.

The supporting framework may have rectangular dimensions.

The elevated, flat playing surface resembling a volleyball net may be supported by a rectangular framework of generally cylindrical straight tubing.

Figure 1A:
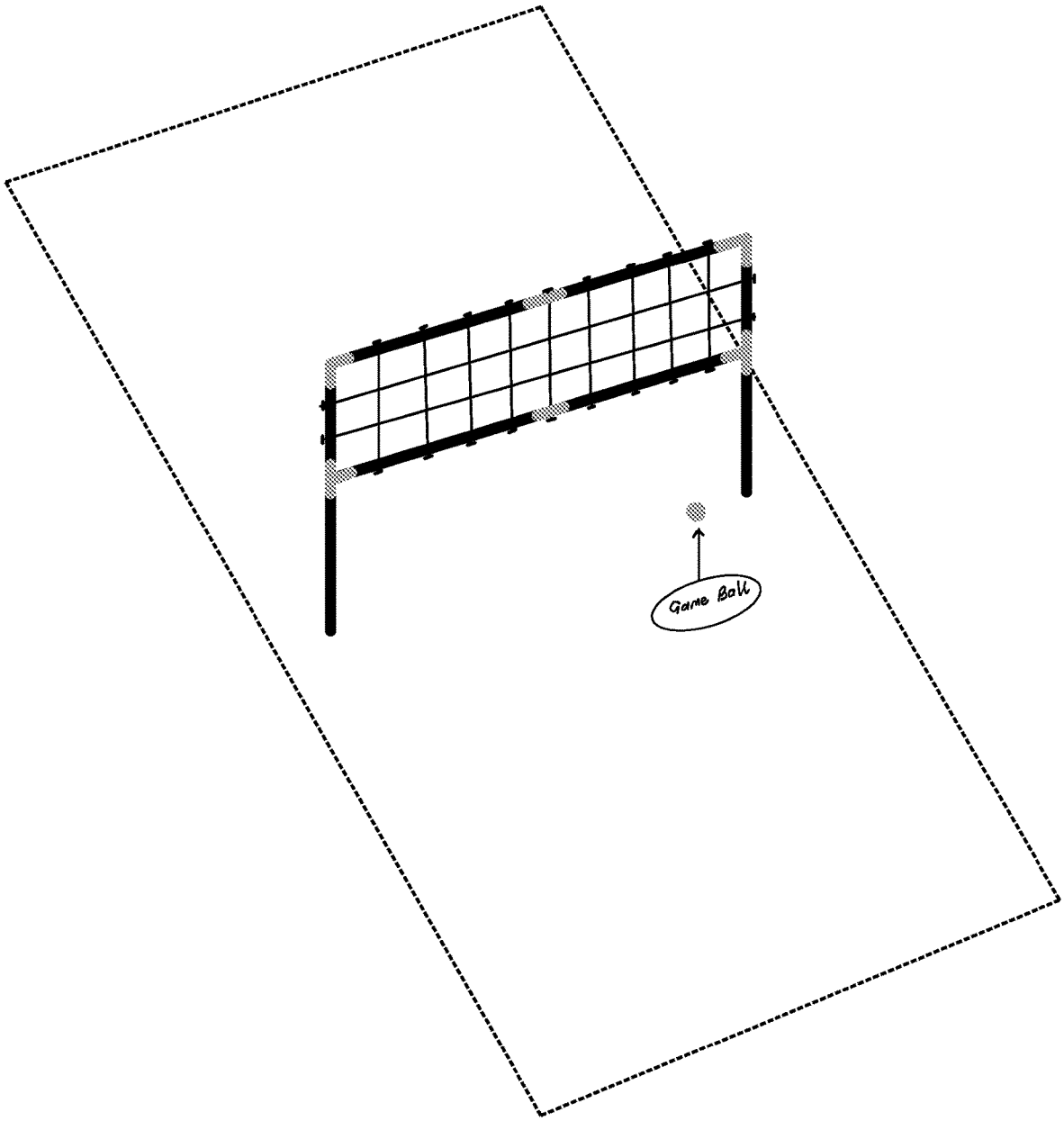
FIG. 1*a* Illustrates an overall view of the game and playing area.
Figure 1B:
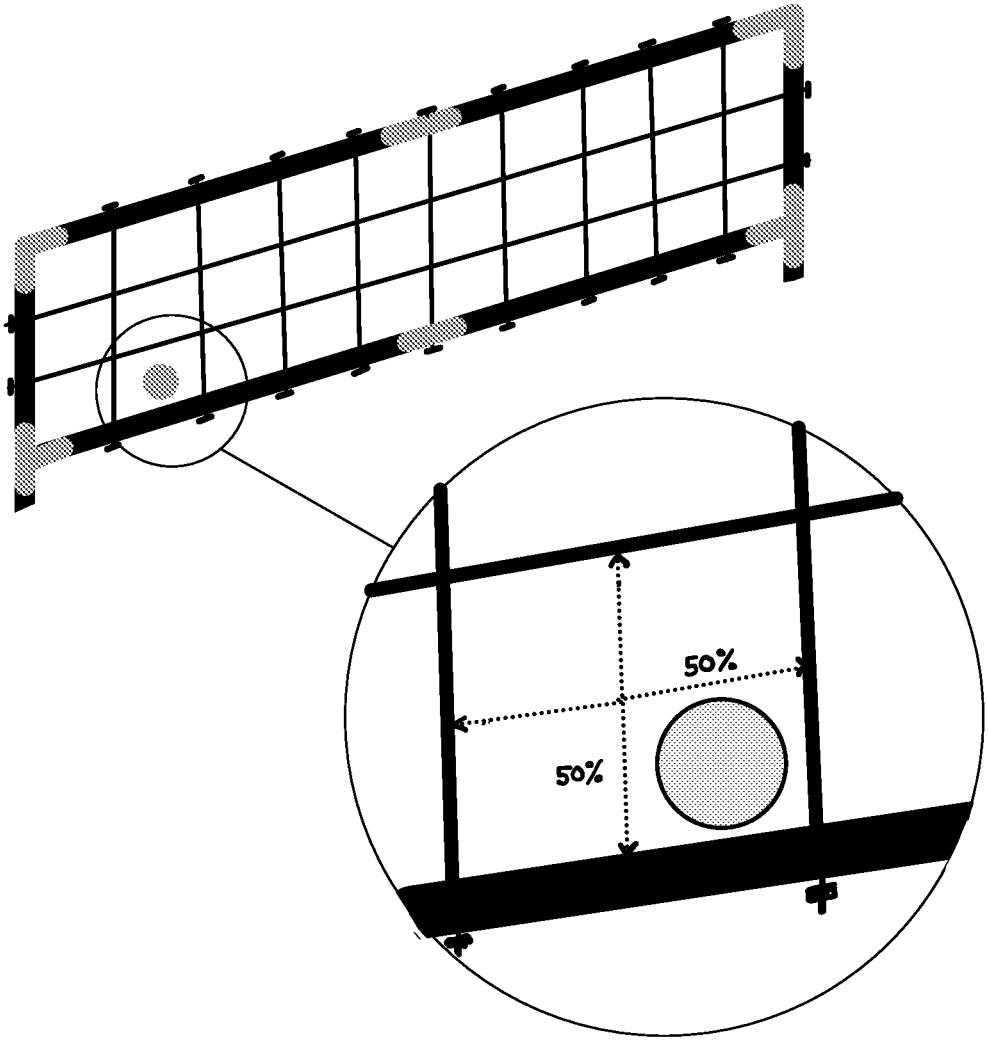
FIG. 1*b* Illustrates the dimensions of the hole (box) in the elevated, flat playing surface in relation to the dimensions of the game ball.
Figure 1C:
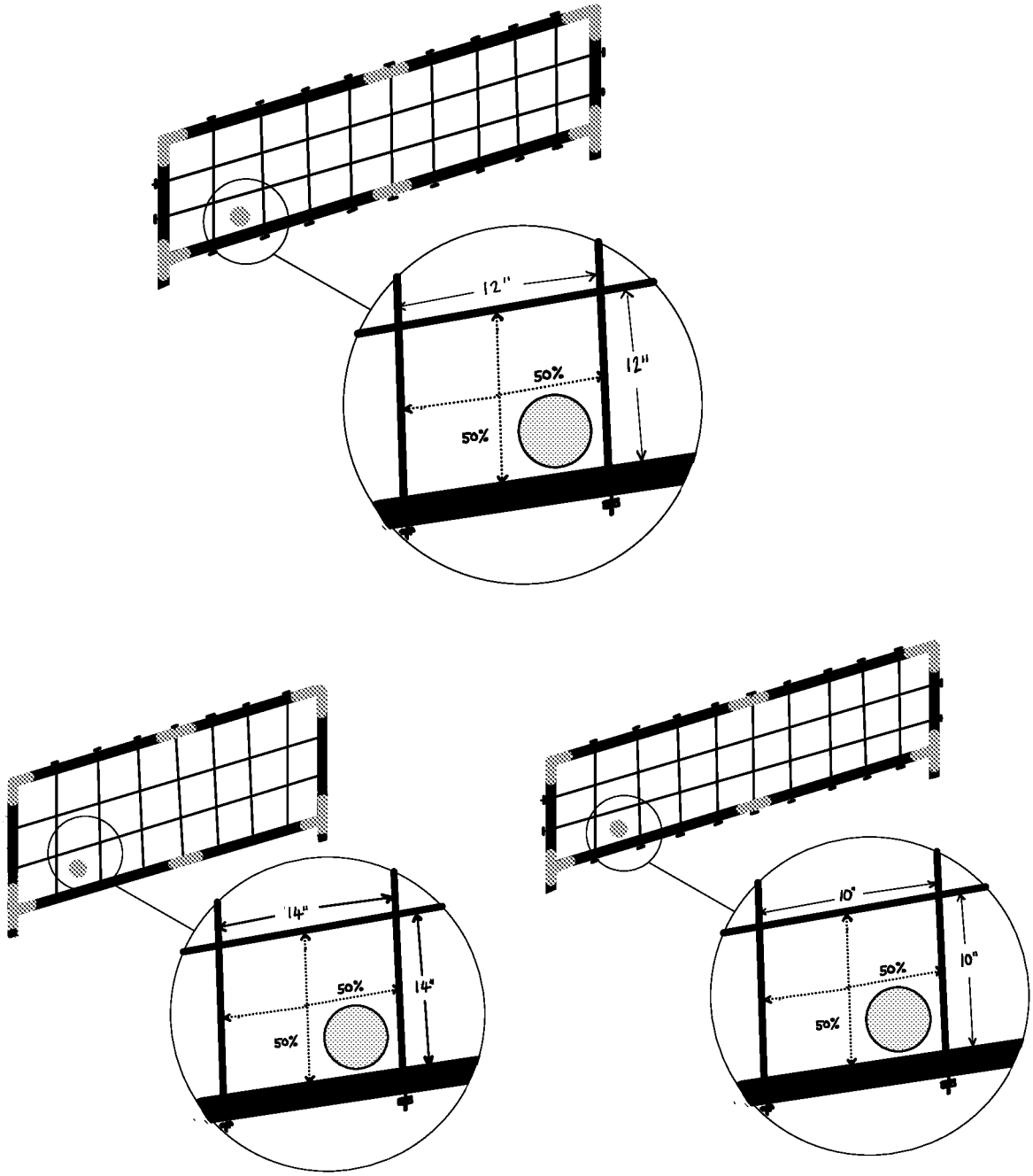
FIG. 1*c* Illustrates the dimensions of the hole (box) in the elevated, flat playing surface in relation to the dimensions of the game ball when there are three rows of ten boxes and each hole (box) in the net is 12 inches×12 inches, when there are three rows of eight boxes and each hole (box) in the net is 14 inches×14 inches, and when there are three rows of ten boxes and each hole (box) in the net is 10 inches×10 inches.

Referring now to FIG. 1*a*, a ball game is provided. The game may have an elevated, flat playing surface resembling a volleyball net, but where there are three rows of ten boxes. Each box in the net is 12 inches×12 inches. In addition, there is a rectangular framework, supporting legs and a ball.

Figure 2:
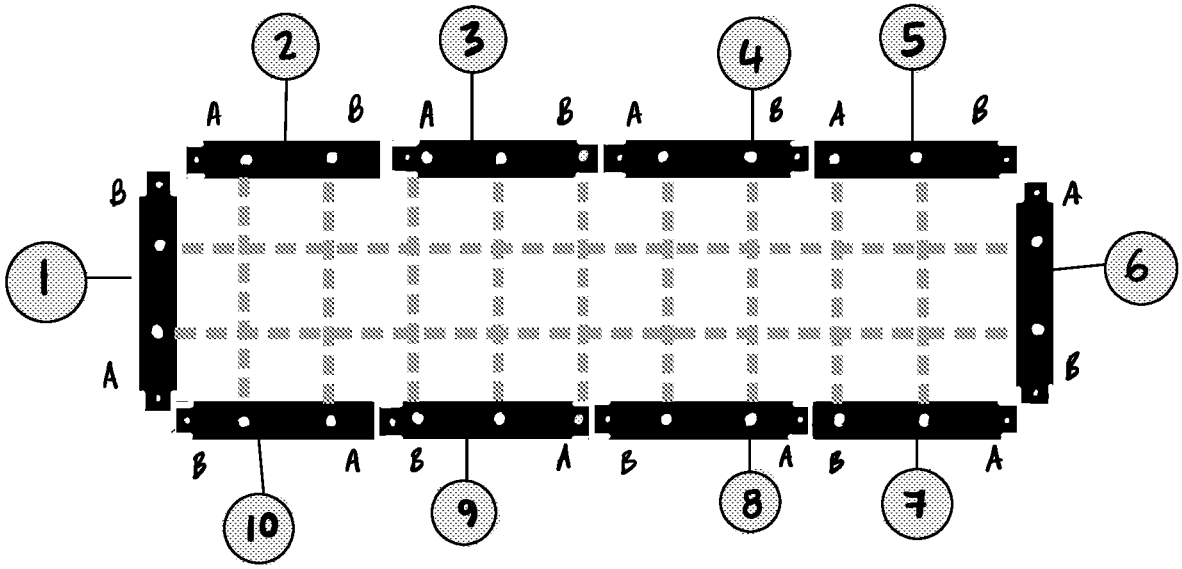
FIG. 2 Illustrates ten generally cylindrical straight tubes that support the elevated, flat playing surface that resembles a volleyball net, but where there are three rows of ten boxes and each hole (box) in the net is 12 inches×12 inches.

Referring now to FIG. 2, the rectangular framework may have ten sections (1), (2), (3), (4), (5), (6), (7), (8), (9) and (10).

Figure 3:
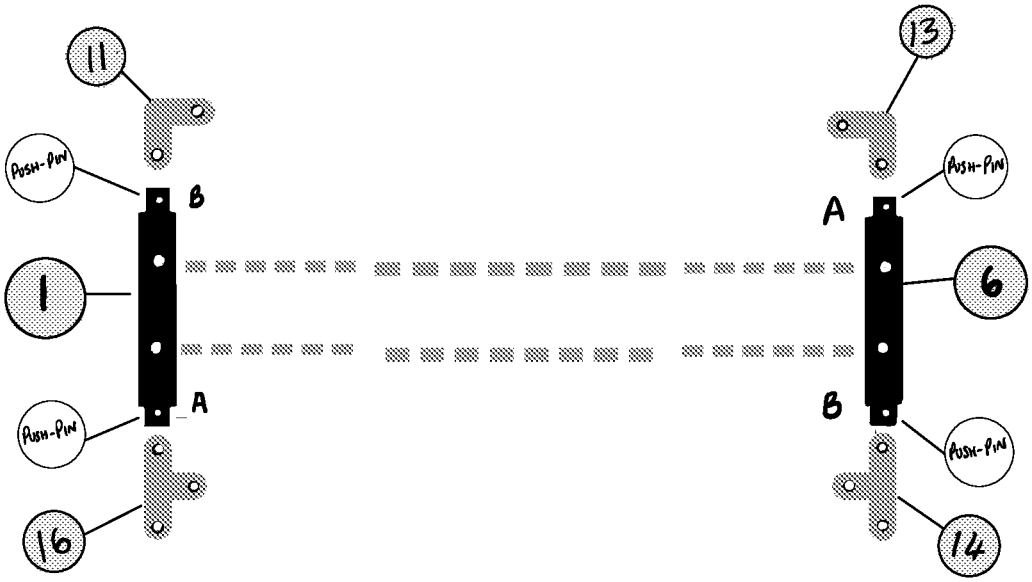
FIG. 3 Illustrates two vertical, generally cylindrical straight tubes and four connectors that support the elevated, flat playing surface that resembles a volleyball net, but where there are three rows of ten boxes and each hole (box) in the net is 12 inches×12 inches.

Referring now to FIG. 3, the rectangular framework may have two vertical sections (1) & (6) and each section may have a first end (A) and a second end (B), and may be generally cylindrical and straight. Holes at regular intervals may be used to attach and secure the elevated, flat playing surface resembling a volleyball net, but where there are three rows of ten boxes. Each box in the net is 12 inches×12 inches. Holes near the first end (A) and the second end (B) may contain push-pins to secure (1A) to (16) and (1B) to (11). Holes near the first end (A) and the second end (B) may contain push pins to secure (6A) to (13) and (6B) to (14).

Figure 4:
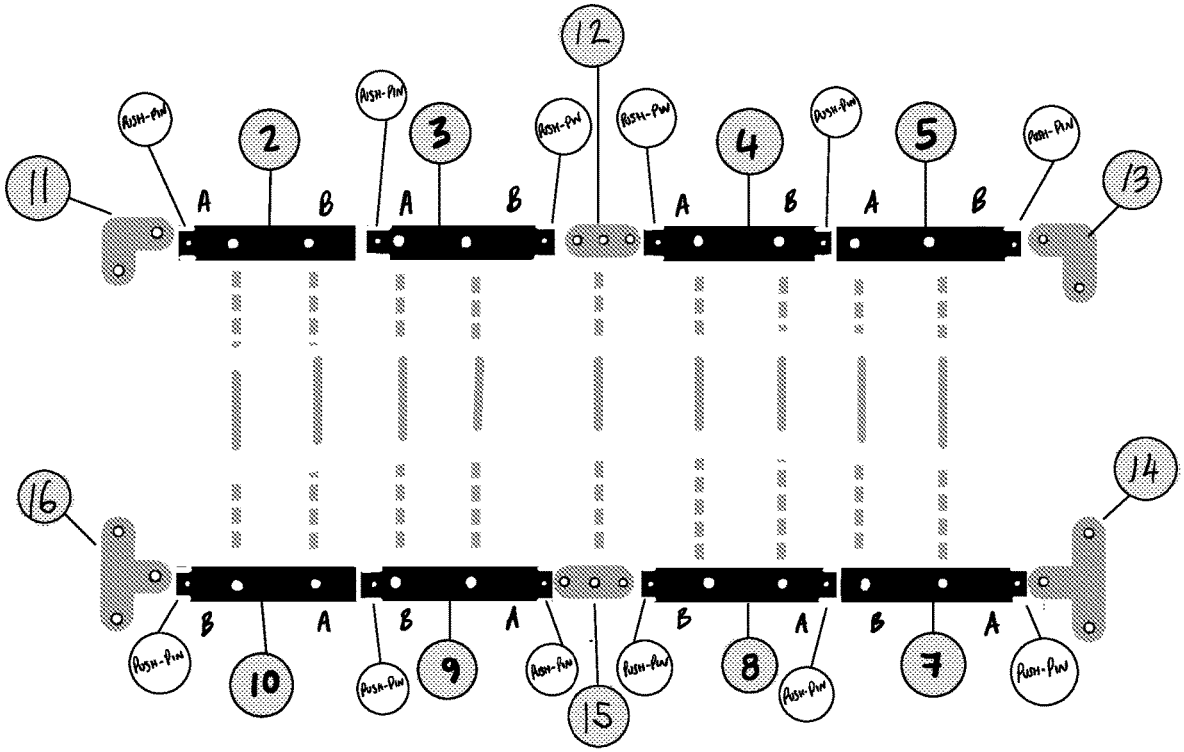
FIG. 4 Illustrates eight horizontal, generally cylindrical straight tubes and six connectors that support the elevated, flat playing surface that resembles a volleyball net, but where there are three rows of ten boxes and each hole (box) in the net is 12 inches×12 inches.

Referring now to FIG. 4, the rectangular framework may have eight horizontal sections (2). (3). (4). (5), (7), (8), (9) & (10) and each section may have a first end (A) and a second end (B), and may be generally cylindrical and straight. Holes at regular intervals may be used to attach and secure the elevated, flat playing surface resembling a volleyball net, but where there are three rows of ten boxes. Each box in the net is 12 inches×12 inches. A hole near the first end (A) may contain a push pin to secure (2A) to connector (11). Holes near the first end (A) and the second end (B) may contain push pins to secure (3A) to (2B) and (3B) to (12). Holes near the first end (A) and the second end (B) may contain push pins to secure (4A) to (12) and (4B) to (5A). A hole near the second end (B) may contain a push pin to secure (5B) to (13). A hole near the first end (A) may contain a push pin to secure (7A) to (14). Holes near the first end (A) and the second end (B) may contain push pins to secure (8A) to (7B) and (8B) to (15). Holes near the first end (A) and the second end (B) may contain push pins to secure (9A) to (15) and (9B) to (10A). A hole near the second end (B) may contain a push pin to secure (10B) to (16).

Figure 5:
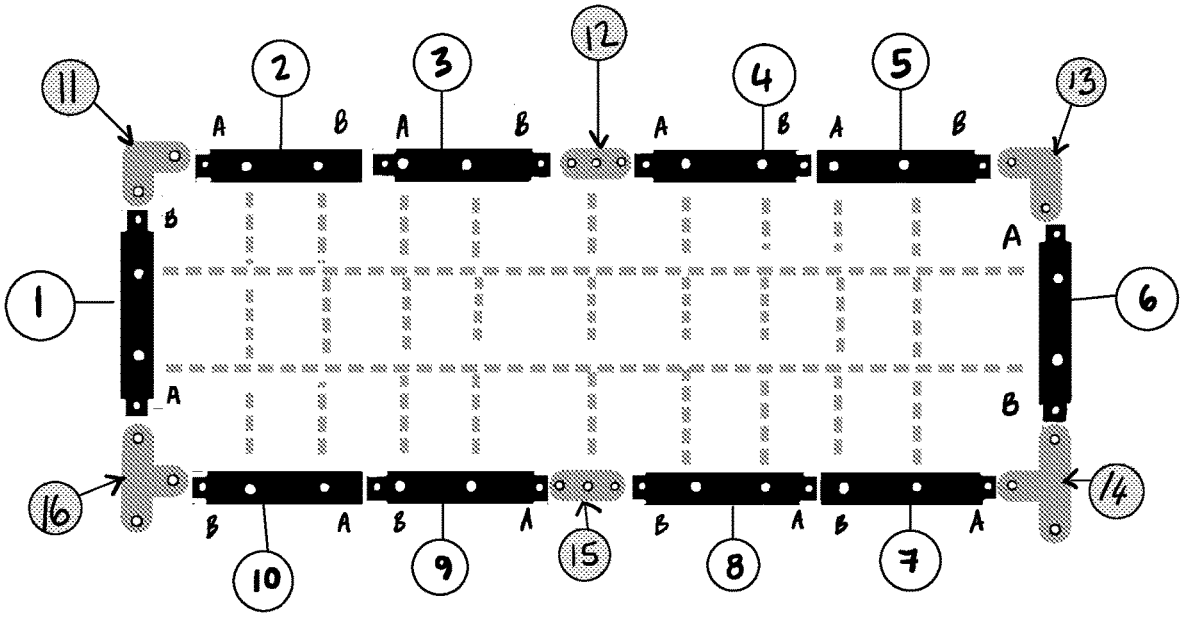
FIG. 5 Illustrates ten generally cylindrical straight tubes with push-pins and six connectors that support the elevated, flat playing surface that resembles a volleyball net, but where there are three rows of ten boxes and each hole (box) in the net is 12 inches×12 inches, and where the six connectors have circular openings, wherein the circular opening receives a portion of the cylindrical straight tubing and is secured by a push-pin.

Referring now to FIG. 5, the rectangular framework may have ten sections (1), (2), (3), (4). (5), (6), (7), (8), (9) & (10) and each section may have a first end (A) and a second end (B), and may be generally cylindrical and straight. The supporting framework may use six connectors: 2×90-degree connectors (11) and (13); 2×180-degree connectors (12) and (15); 2×T-connectors (14) and (16). Holes in the supporting framework may be used to attach and secure the elevated, flat playing surface resembling a volleyball net, but where there are three rows of ten boxes. Each box in the net is 12 inches×12 inches. The second end of the first section (1B) may connect to the first end of the second section (2A) using a two-way 90-degree connector (11). The second end of the second section (2B) may directly connect to the first end of the third section (3A). The second end of the third section (3B) may connect to the first end of the fourth section (4A) using a straight two-way 180-degree connector (12). The second end of the fourth section (4B) may directly connect to the first end of the fifth section (5A). The second end of the fifth section (5B) may connect to the first end of the sixth section (6A) using a two-way 90-degree connector (13). The second end of the sixth section (6B) may connect to the first end of the seventh section (7A) using a three-way T connector (14). The second end of the seventh section (7B) may directly connect with the first end of the eighth section (8A). The second end of the eighth section (8B) may connect with the first end of the ninth section (9A) using a straight two-way 180-degree connector (15). The second end of the ninth section (9B) may directly connect with the first end of the tenth section (10A). The second end of the tenth section (10B) may connect with the first end of the first section (1A) using a three-way T connector (16).

Figure 6:
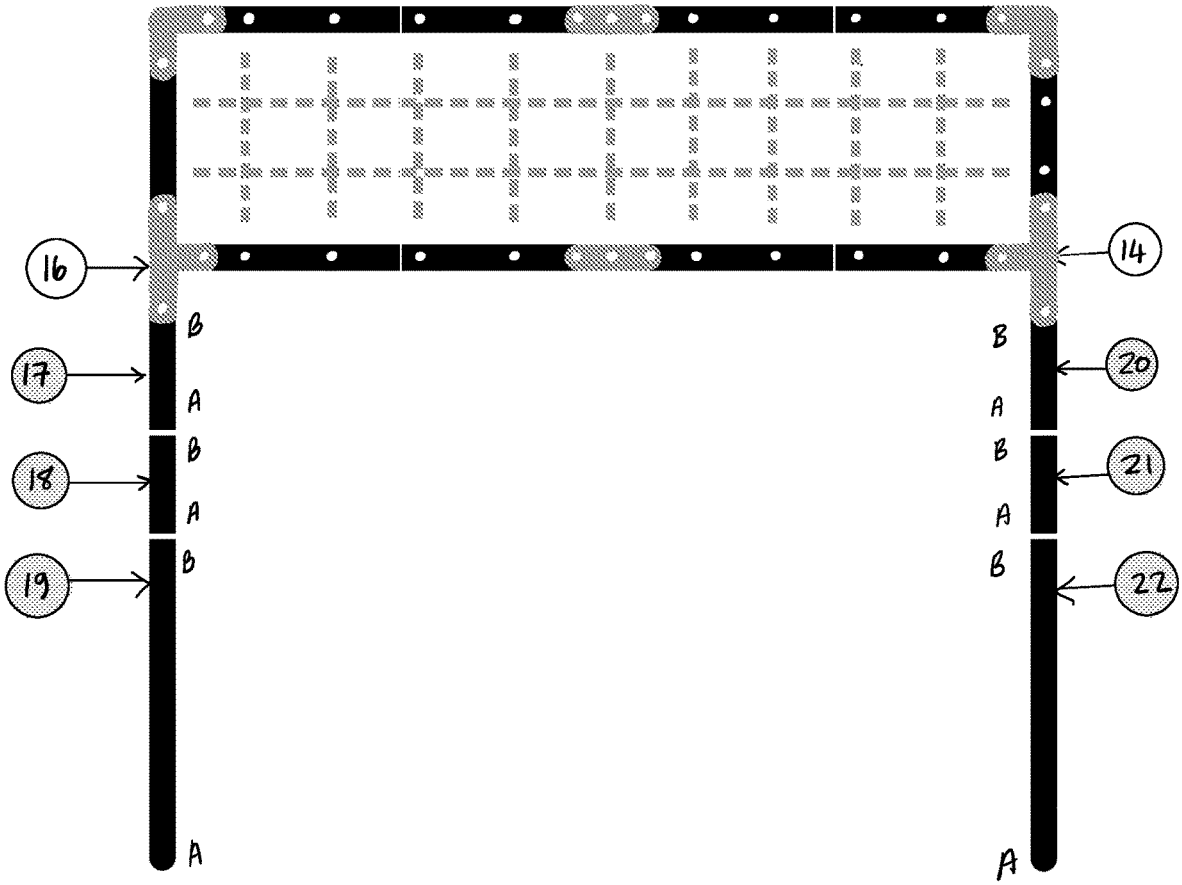
FIG. 6 Illustrates ten generally cylindrical straight tubes with push-pins and six connectors that support the elevated, flat playing surface that resembles a volleyball net, but where there are three rows of ten boxes and each hole (box) in the net is 12 inches×12 inches, and where the six connectors have circular openings, wherein the circular opening receives a portion of the generally cylindrical straight tubing and is secured by a push-pin. The rectangular frame is supported by six generally cylindrical straight tubes with push-pins, serving as two legs, wherein each leg may consist of three generally cylindrical straight tubes with push-pins.

Referring now to FIG. 6, the second end of the seventeenth section (17B) may connect to a three-way T connector (16). The second end of the eighteenth section (18B) may connect to the first part of the seventeenth section (17A). The first end of the eighteenth section (18A) may connect to the second part of the nineteenth section (19B). The second end of the twentieth section (20B) may connect to a three-way T connector (14). The second end of the twenty-first section (21B) may connect with the first part of the twentieth section (20A). The first end of the twenty-first section (21A) may connect with the second end of the twenty-second section (22B).

Figure 7:
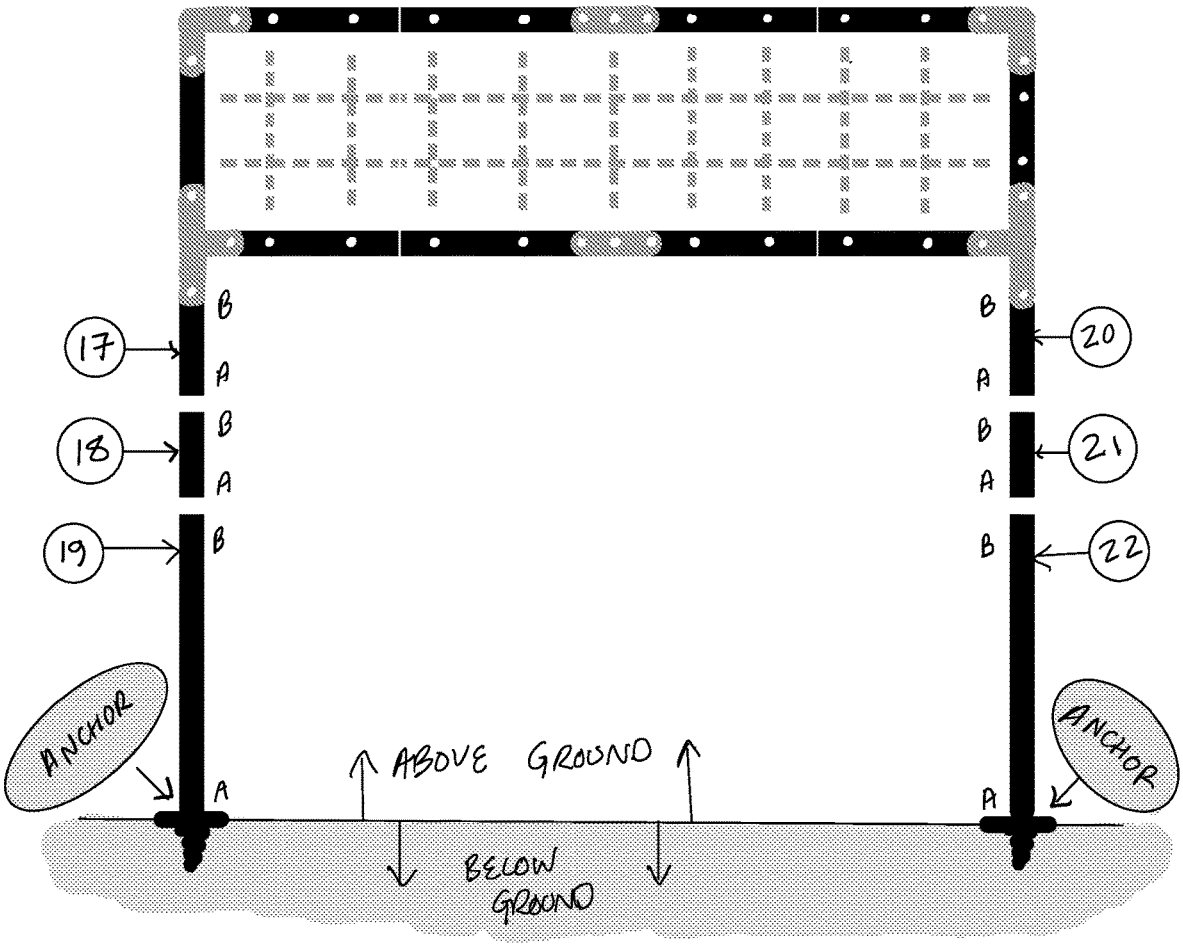
FIG. 7 Illustrates ten generally cylindrical straight tubes with push-pins and six connectors that support the elevated, flat playing surface that resembles a volleyball net, but where there are three rows of ten boxes and each hole (box) in the net is 12 inches×12 inches, and where the six connectors have circular openings, wherein the circular opening receives a portion of the generally cylindrical straight tubing and is secured by a push-pin. The rectangular frame is supported by six generally cylindrical straight tubes with push-pins, serving as two legs, wherein each leg may consist of three generally cylindrical straight tubes with push-pins, and where each leg is secured to the ground by an anchor.

Referring now to FIG. 7, the legs (17), (18), (19), (20), (21) and (22) may have a first end (A) and a second end (B), and may be generally cylindrical and straight. The legs (19) and (22) may be secured using anchors positioned on the ground, grass, or sand.

Figure 8:
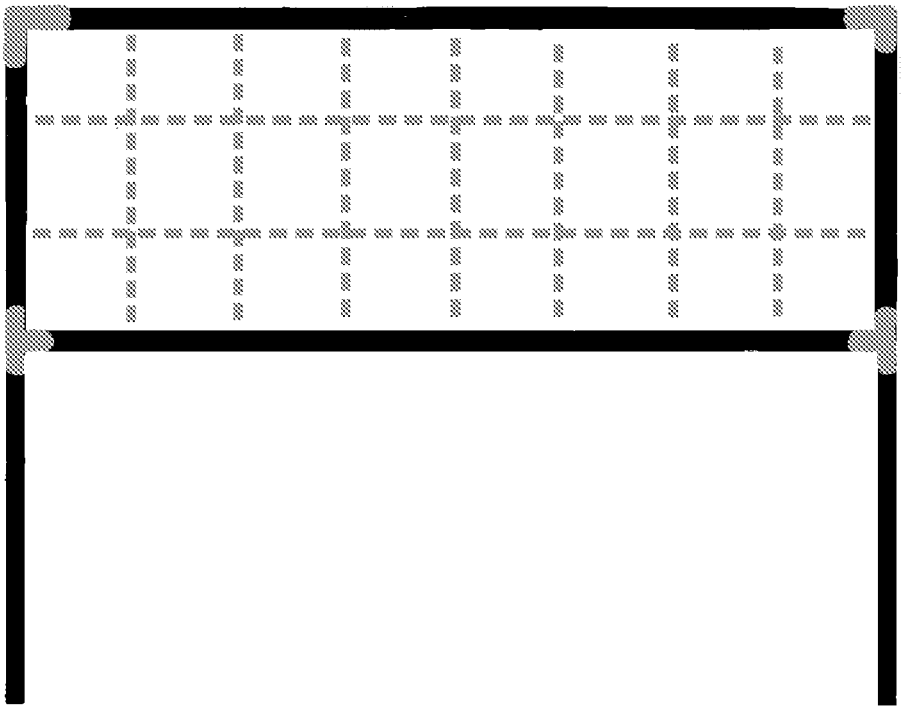
FIG. 8 Illustrates an embodiment (Boxxyball Xtra) where the ball game has an elevated, flat surface which resembles a volleyball net, but where there are three rows of eight boxes. Each hole (box) in the net is 14 inches×14 inches, the game ball is around 6 inches in diameter, and the game may be played by younger players.

Referring now to FIG. 8, in another embodiment (Boxxyball Xtra) where the ball game has an elevated, flat surface which resembles a volleyball net, but where there are three rows of eight boxes. Each hole (box) in the net is 14 inches×14 inches, the game ball is around 6 inches in diameter, and the game may be played by younger players.

Figure 9:
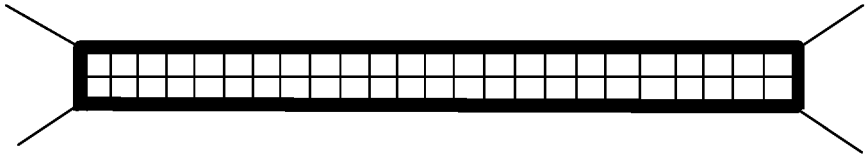
FIG. 9 Illustrates an embodiment (Boxxyball Xtreme) where the ball game has an elevated, flat surface which resembles a volleyball net, but where there are two rows of twenty-four boxes. Each hole (box) in the net is 14 inches× 14 inches, the game ball is around 6 inches in diameter, and the game may be played on a regular volleyball court.

Referring now to FIG. 9, in another embodiment (Boxxyball Xtreme) where the ball game has an elevated, flat surface which resembles a volleyball net, but where there are two rows of twenty-four boxes. Each hole (box) in the net is 14 inches×14 inches, the game ball is around 6 inches in diameter, and the game may be played on a regular volleyball court.

Figure 10:
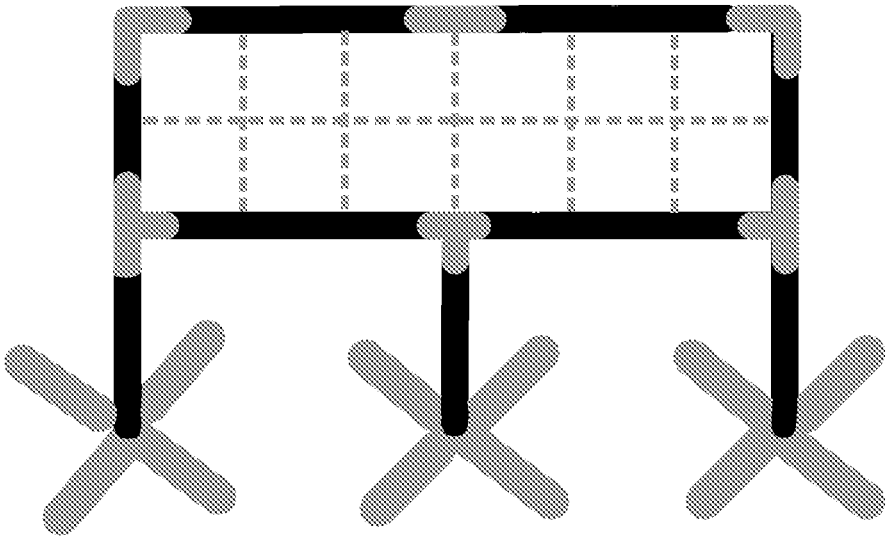
FIG. 10 Illustrates an embodiment (Boxxyball Aqua) where the ball game has an elevated, flat surface which resembles a volleyball net, but where there are two rows of six boxes. Each hole (box) in the net is 14 inches×14 inches, the game ball is around 6 inches in diameter, and the game may be played in water.

Referring now to FIG. 10, in another embodiment (Boxxyball Aqua) where the ball game has an elevated, flat surface which resembles a volleyball net, but where there are two rows of six boxes. Each hole (box) in the net is 14 inches×14 inches, the game ball is around 6 inches in diameter, and the game may be played in water.

Figure 11:
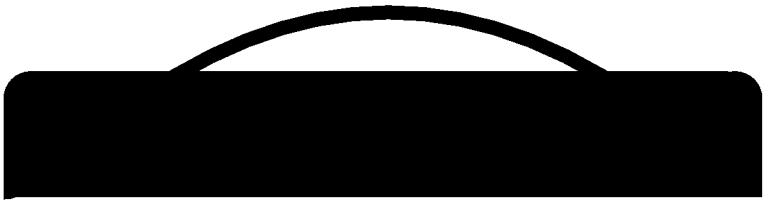
FIG. 11 Illustrates a carrying bag to store and transport the game.

Referring now to FIG. 11, in an embodiment, the game may neatly be disassembled and transported in a carrying bag.

Playing the Game

Boxxyball is a catch-and-throw ball game that can be played on the beach, at the park, on a hard surface (indoor or outdoor), or even in water. The game equipment involves a unique feature. The elevated, flat surface which resembles a volleyball net contains three rows of ten boxes, where each hole (box) in the net is 12 inches×12 inches and the game ball is around 5 inches in diameter. The novel aspect of Boxxyball is that the game is played by throwing the ball through the net.

In the standard embodiment of the game, the net may consist of three rows of ten boxes, where each box is 12 inches×12 inches, and the game ball may be around 5 inches in diameter.

In another embodiment, the net may consist of three rows of eight boxes, where each box is 14 inches×14 inches, and the game ball may be around 6 inches in diameter.

In another embodiment, the net may consist of two rows of twenty-four boxes, where each box is 14 inches×14 inches, and the game ball may be around 6 inches in diameter.

In another embodiment, the net may consist of two rows of six boxes, where each box is 14 inches×14 inches, and the game ball may be around 6 inches in diameter.

To play the game, a user assembles the game and marks out the playing area (which is dependent upon the version of the game).

Gameplay 1v1:

Each player is permitted to touch the ball once on their side of the court. The first player stands behind the line at the rear of the playing area and serves the ball by throwing it through any hole (box) in the net. If the ball fails to pass through a hole (box) in the net, service is lost and passes to the player on the other side. If the ball passes through but touches the net and is redirected straight down on the other side ("net drop"), this is ruled "unplayable" and the serve is retaken. If the ball passes through (the ball may touch the net, as long as it's ruled "playable,") the player on the other side must catch the ball before it hits the ground, and with one second to release the ball, return it by throwing it through any hole (box) in the net. The serving player must catch the ball before it hits the ground, and with one second to release the ball, return it in the same way. The game continues. At any point in the game, if the ball bounces off the net, the touch-count resets, so a player may catch it before it hits the ground and try again (and again . . . , and again . . . ).

NOTE: "Net drops" are serves that go through the net but are ruled unplayable.

How to score a point:

The ball touches the ground on the opposite side of the court.

An opponent fails to return the ball.

An opponent returns the ball, but it lands outside the playing area.

An opponent touches the ball more than once, consecutively.

An opponent holds the ball longer than one second.

A player must be serving the ball to score a point.

The ball cannot be hit with a first or open hand—it must be caught and thrown.

A player cannot travel with the ball.

A player may not use their body to block the net.

Gameplay: 2v2 or More . . . :

Similar rules apply. The game begins by serving the ball through any hole (box) in the net, but the receiving player may pass to a teammate or directly return the ball. After the ball is served, each team may touch the ball up to three times on their side of the court (the same player cannot touch the ball more than once, consecutively). If the ball bounces off the net the "touch-count" resets, so the team in possession may catch it before it hits the ground and use up to three touches to try again (and again, and again . . . ).

During teamplay, players rotate to serve the ball, and non-serving players may stand anywhere on the court.

Official or house rules may be used.

In an alternative embodiment, the game may be played on a different surface, with the legs secured or stabilized to enable gameplay on that particular surface.

In an alternative embodiment, the game may be played with different dimensions, e.g., a lower net and larger boxes may be suitable for younger or older players.

In an alternative embodiment, the game may be played in water, with the net secured in or over a body of water or swimming pool.

In an alternative embodiment, the game may be played with an extended net that allows more people to play, e.g., using a regular-sized volleyball court.

Although embodiments of the invention are shown and described herein, it should be understood that various changes and modifications to the presently preferred embodiments will be apparent to those skilled in the art. Such changes and modifications may be made without departing from the spirit and scope of the invention and without diminishing its attendant advantages.

REFERENCES CITED

U.S Patent Documents

U.S. Pat. No. 277,551 May 1883 S. Cunningham
U.S. Pat. No. 755,936 March 1904 J. H. Ricau
U.S. Pat. No. 1,362,238 December 1920 P. A. Dietz
U.S. Pat. No. 4,153,247 May 1979 Everett M. Burns
U.S. Pat. No. 435,719 November 1982 Howard L. Wouters
U.S. Pat. No. 4,826,178 May 1989
Scott Brian Cloran U.S. Pat. No. 5,018,746 May 1991 Joseph W. Cardoza, Jr.
U.S. Pat. No. 5,303,932 April 1994 Brian D. Kessler
U.S. Pat. No. 5,816,956 October 1998 John Ellis, Christopher Harms U.S. Pat. No. 4,457,513 July 1984
Richard B. Thompson U.S. Pat. No. 5,674,139 October 1997 John D. Brooks
U.S. Pat. No. 6,461,258 October 2002 Michael M. Vacanti
D722660 February 2015 Zhong Chun Yuan
U.S. Pat. No. 10,376,763 August 2019 William D. Crosby
U.S. Pat. No. 10,226,679 March 2019 David Nelson, John Lucas D877,827 March 2020 Ning Xie

I claim:

1. A ball game comprising:

a. a net having an elevated, flat surface which resembles a volleyball net, wherein the net has three rows of ten boxes, each box represents a hole in the net, that is 12 inches×12 inches, b. a game ball approximately 5 inches in diameter, for throwing through the net, c. a plurality of supports wherein the plurality of supports have a first end and a second end, and wherein the first end is located near the elevated net, and the second end is located near the ground, d. a plurality of generally cylindrical straight tubing wherein the plurality of generally cylindrical straight tubing, when assembled, forms a rectangle that surrounds and supports the elevated net, e. a plurality of connector fittings which connect the plurality of generally cylindrical straight tubing, wherein the plurality of connector fittings have a circular opening wherein the circular opening receives a portion of the plurality of generally cylindrical straight tubing, f. a plurality of push-pins which connect the plurality of connector fittings to the plurality of cylindrical straight tubing, where a plurality of connector fittings have a circular opening wherein the circular opening receives a portion of the plurality of generally cylindrical straight tubing.

2. The ball game of claim 1, wherein the plurality of push-pins inserted in the generally cylindrical straight tubing connect to the plurality of connector fittings.

3. The ball game of claim 1, wherein the length of the plurality of generally cylindrical straight tubing is straight.

4. The ball game of claim 1, wherein the elevated net, consists of netting that is secured and held in tension by the plurality of generally cylindrical straight tubing connected to the connector fittings using push-pins.

5. The ball game of claim 1, wherein the ball game has an elevated, flat surface which resembles a volleyball net, where there are two rows of twenty-four boxes, where each hole (box) in the net is 14 inches×14 inches, where the game ball is around 6 inches in diameter, and the game may be played on a regular volleyball court.

6. The ball game of claim 1, wherein the ball game has an elevated, flat surface which resembles a volleyball net, where there are two rows of six boxes, where each hole (box) in the net is 14 inches×14 inches, where the game ball is around 6 inches in diameter, and the game is played in water.

* * * * *